United States Patent [19]

Gertsch et al.

[11] 4,172,602

[45] Oct. 30, 1979

[54] SAFETY SKI BINDING

[75] Inventors: Ernest Gertsch; Ulrich Gertsch, both of Bern, Switzerland

[73] Assignee: TMC Corporation, Baar, Switzerland

[21] Appl. No.: 725,541

[22] Filed: Sep. 22, 1976

Related U.S. Application Data

[63] Continuation-in-part of Ser. No. 204,031, Dec. 2, 1971, abandoned.

[30] Foreign Application Priority Data

Dec. 3, 1970 [CH] Switzerland ..... 17970/70

[51] Int. Cl.[2] ..... A63C 9/08

[52] U.S. Cl. ..... 280/618

[58] Field of Search ..... 280/618, 617, 616, 613, 280/627, 607

[56] References Cited

U.S. PATENT DOCUMENTS

| | | | |
|---|---|---|---|
| 3,489,424 | 1/1970 | Gertsch et al. | 280/618 |
| 3,838,866 | 10/1974 | D'Alessio et al. | 280/613 |
| 3,900,205 | 8/1975 | Sittmann | 280/618 |

FOREIGN PATENT DOCUMENTS

| | | | |
|---|---|---|---|
| 1445765 | 6/1966 | France | 280/626 |
| 77728 | 10/1950 | Norway | 280/617 |
| 412672 | 11/1966 | Switzerland | 280/620 |
| 462017 | 10/1968 | Switzerland | 280/618 |
| 443089 | 1/1969 | Switzerland | 280/618 |

*Primary Examiner*—Joseph F. Peters, Jr.
*Assistant Examiner*—Milton L. Smith
*Attorney, Agent, or Firm*—Martin A. Farber

[57] ABSTRACT

A releasable safety ski binding holding a release plate, having a safety release device secured to the ski for releasably holding the release plate to the ski. A heel holder is longitudinally non-adjustably mounted on the rear of the release plate, and a toe holder is adjustably disposed on the front of the release plate to hold different size ski boots without affecting the safety release holding of the binding. In another embodiment, the safety ski binding has a lateral and vertical safety release member only adjacent one end of the release plate, the other end of the release plate defining a vertical release pivot fulcrum. The release plate is pivotally mounted on the ski intermediate its ends, whereby different lateral and vertical release moments exist.

16 Claims, 7 Drawing Figures

SAFETY SKI BINDING

The present application is a continuation-in-part application of our co-pending application Ser. No. 204,031 which was filed on Dec. 2, 1971 and entitled Safety Ski Binding and now abandoned.

The present invention relates to a new and improved construction of a safety ski binding of the type incorporating a release plate for fixedly non-shiftably retaining the ski boot. A pivot bearing permits the rear portion of the release plate to laterally pivot; the release plate is also arranged such that it can be raised off the pivot bearing.

The safety ski binding in accordance with the invention further possesses a construction wherein the front region or end of the release plate engages a guide track disposed substantially concentrically relative to the axis of rotation of the pivot bearing.

Ski bindings of such basic types, particularly those having a release plate mounted at a pivot bearing or support possess the advantage, to the contrary of safety bindings which do not use a pivot bearing, that during a sudden thrust in the lengthwise direction of the ski, the release plate does not change its position, and therefore the safety factor or security offered by such safety bindings is not changed nor impaired.

With the heretofore known ski bindings of this type, generally a front safety holder device is provided for the tip of the ski boot during lateral pivoting of the release plate. This safety holder device releases the ski boot; however, the plastic range necessary for damping impacts which occur during skiing is limited during the lateral release. A further drawback of such previously known ski bindings resides in the fact that an extreme bending-through of the ski occurs, and due to the resulting shortening of the ski, a relatively pronounced change occurs in the release factor.

Norwegian Pat. No. 77 728 (Vister) is known of a different basic type in which only a sole plate together with an integral heel stop is longitudinally adjustably supported for movement in the lengthwise direction relative the ski at its anchoring. Longitudinal movement is not possible for the front clamping jaws or toe holders, since the toe jaw plates are secured by screws which extend through openings having circular surfaces in the toe jaw plates. Since the position of the screws are fixed by nuts (which are integral parts of an extension of the base mounting plate of the anchoring), the position of the toe holders is also fixed relative to the lengthwise direction of the ski. The toe jaw plates are only adjustable laterally, due to lateral arcuate guide bearings through which the front screws relatively moveably extend. The heel holder together in integral connection with the sole plate is lengthwise adjustable relative to the ski and must be so moved relative the ski, the anchoring and the toe jaws in the event a different size boot is to be accommodated. Although this patent also does not provide or mention safety release devices for a release plate, if it did the release devices would be affected by such a longitudinal movement of the sole release plate.

By Swiss Pat. No. 412,672 there is known a vertically and laterally pivotal sole plate whch is held solely against vertical pivoting by a rear settable spring safety holder, and the lateral release is controlled by a separate front safety release holder which acts on the tip of the ski boot exclusively effecting the lateral holding moment of the sole plate. Although the vertical release lever arm is thus larger than the lateral release lever arm, there is no guarantee that the respective vertical and lateral release moments will be so maintained in this proportion when a person adjusts the release safety holders, since the different separate lateral and vertical safety holders provide different forces for the respective types of release moments. The skiier must be careful to properly set the rear and/or front safety holders to avoid injury in the event of a fall.

Prior art ski bindings of the general type employing a release plate typically provide an adjustable heel holder mechanism which allows accomodation of the binding to different sizes of ski boots. Typical in this regard are U.S. Pat. No. 3,489,424 and Swiss Pat. No. 443,089. With the same position of the tip of the boot, and as a function of the size of the ski boot, the position of the heel is changed with such prior art boot size adjustment devices, and therefore also is that portion of the sole of the boot which is located beneath the lower ankle or axis of the skier's leg. Thus, depending upon the size of the boot, different conditions prevail with respect to the release mechanism of the binding; for the correct adjustment of the binding, therefore, not only must the size and the weight of the skier be carefully taken into consideration, but also the boot size.

Therefore, it is one object of the present invention to provide a safety ski binding of the releasable plate type which at least substantially eliminates the effect of the size of the boot upon the release action, setting and adjustment of the binding; i.e. the setting of the binding thus being made independent of the size of the ski boot.

According to another object of the invention, only the toe holder mechanism is adjustable to different ski boot sizes at the toe region of the associated ski boot and the heel binding devices are fixed relative to the ski and to the release plate.

It is also a general object of the present invention to provide a safety ski binding of the introductory mentioned type which is not associated with the previously mentioned drawbacks and limitations of the prior art constructions and which has an improved construction which effectively and reliably fulfills the aforementioned existing needs in the art.

Still another object of the invention is to provide a ski binding wherein inherently different relatively proportioned release moments exist for the vertical release action and for the lateral release action and which cannot be changed inadvertantly by a person adjusting the setting. It is beneficial to have different relative magnitudes of the release actions for the vertical and lateral release actions, with the moment exerted by the binding upon the release plate for opposing the lateral release action always safely being required to be smaller than the moment exerted by the binding for opposing the vertical release action, since a safety binding should open easier under torsion than by forces exerted in the longitudinal axis of the ski due to the acceptable forces which a leg can endure.

In accordance with this object, by the present invention the pivot bearing is provided on the ski for laterally pivotally mounting the release plate thereon with a releaseable lateral as well as vertical safety holder provided solely at one end (e.g., the rear end) of the release plate, and with the other end of the release plate thus not being held, but acting as a pivot fulcrum for the vertical release. In this manner proportioned release moments exist for the ski binding for the vertical release action and for the lateral release action, respectively, with their respective lever arms being properly invariably larger and smaller, respectively. In combination with only the single release plate safety holder having one setting for both the vertical and lateral holding actions, the built-in safety ratio of the vertical to the lateral release moment cannot inadvertently be changed, due to the built-in safety-proportioned vertical and lateral release lever arms, respectively.

Still another object of the present invention relates to a novel construction of a safety ski binding which provides a positive release action, thereby providing maximum security for the skier, wherein the binding itself is relatively simple in construction, economical to manufacture, easy to set, and functions positively.

Further the safety ski binding is formed with a counter surface which cooperates with the rear safety holder having a spring-loaded pin at the rear end of the release plate. The counter surface of the release plate is formed such that the spring-loaded pin, during lateral pivoting of the release plate, becomes tensioned or stressed and tends to pivot the release plate back into its starting position. Consequently, during the lateral release action, for example, there is provided a substantially greater elastic range and the binding is insensitive to thrust forces acting upon the ski boot during normal skiing conditions. The front of the release plate is not held by any vertical or lateral holding action, but is provided with a member which provides the front of the release plate to be the pivot fulcrum for the forward or vertical release operation. During a lateral release as well as also during a forward release action of the binding, the respective axis of rotation advantageously remains always at the same location. The precisely defined axis of rotation of the pivot bearing can be located at the extension of the axis of the skier's leg. Furthermore, any pronounced flexing or bending through of the ski does not influence the release factor.

With the above and other objects, the invention will become better understood from the following detailed description of a preferred embodiment thereof, in connection with the drawings, wherein.

Figure 1:
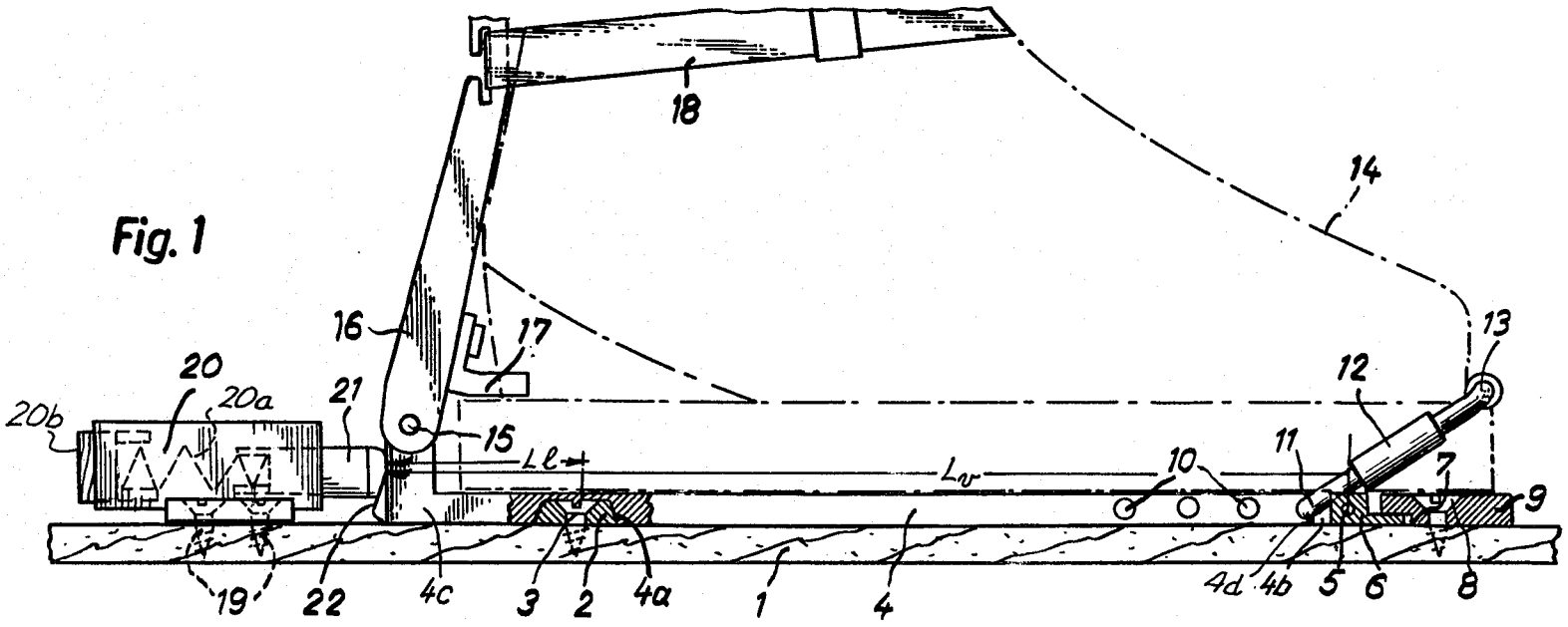
FIG. 1 is an elevational view, partly in longitudinal section, of a preferred constructional form of a safety ski binding of the invention, shown mounted on a ski, the latter being broken away.

Referring now to the drawings, a pivot bearing in the form of a frustoconical bearing disc 2 is attached by means of screws 3 or the like to a ski 1. A release plate 4 is longitudinally immoveably disposed on the ski 1 and rotatably mounted on this bearing disc 2 constituting a lateral release pivot fulcrum; the release plate 4 is formed with a slightly tapering conical bore or opening 4*a* complementary to the periphery of the bearing disc 2. At the front region or end 4*b* of the release plate 4, an hinge engagement element 6 is hingedly or pivotably mounted on the release plate by means of a pivot or hinge pin 5 which passes through aligned bores 6*a* and 4*g* in the hinge element 6 and the release plate, respectively.

The hinge engagement element 6 slidably engages with a guide track 7, the latter being concentrically disposed with respect to the axis of the bearing disc 2. The guide track 7 is formed by a holder plate 9 which is attached to the ski by means of screws 8 or the like. The holder plate 9 does not provide any lateral holding force other than negligible friction, but merely cooperates with the hinged engagement member 6 to constitute the pivot axis 5 of the hinge 6 and release plate 4 as the invariable pivot fulcrum of the forward (vertical) release.

A ski boot toe holder mechanism 10–13 is provided on the front of the release plate 4. Furthermore, the release plate 4 is formed with a plurality of lateral holes 10 at the forward portion of the release plate 4. At each side of the release plate 4, a respective angled spindle or arm 11 is threadably connected with one of the holes 10, and at the opposite end of each angled spindle arm 11, a respective adjustment sleeve 12 is adjustably threaded thereto. Further, both of these lateral adjustment sleeves 12 are threaded or screwed onto a holder bracket 13. The latter engages with the tip of the ski boot 14 above its sole, thereby fixedly retaining the front of the ski boot against the release plate 4, as shown in FIG. 1. Adjustment of the front toe holder mechanism 10–13 to different size boots does not change the forward or vertical release pivot fulcrums of the release plate 4.

At the rear region end 4*c* of the release plate 4, a support or carrier arm 16 is pivotably mounted thereto by means of a transversely extending pivot shaft 15. A heel holder member 17 is mounted on the carrier arm 16, the heel holder member 17 engaging a heel recess region of the ski boot 14, thereby fixedly holding the boot at its rear end against the release plate 4. An instep strap 18 is mounted on the upper end of the carrier arm 16, the instep strap 18 engaging around the upper of the ski boot 14. The heel holder 15–18 thus constitues a non-adjustable ski boot heel holder which is longitudinally immovable relative to the release plate 4, the ski 1 and the rear safety holder 19–22, which are all lengthwise immovable relative to each other in the normal skiing position of the combination, for any size ski boot held also relatively immovable thereon, in the same position as shown in FIG. 1, yet of course releaseable.

Figure 2:
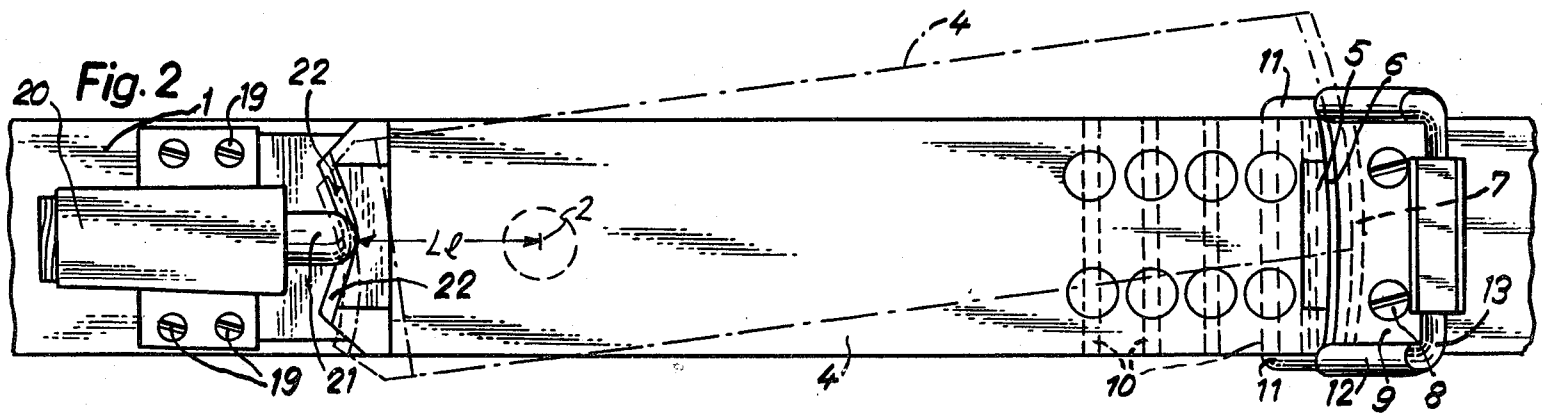
FIG. 2 is a top plan view of the safety ski binding of FIG. 1.

A spring-loaded pin 21 is displaceably guided in a housing of a rear safety release member 20, the latter being immovably secured to the ski by means of screws 19 or the like. A compression or pressure spring 20*a* is housed in the housing 20 and acts upon this pin 21, the spring tending to forwardly displace the pin 21. The spring 20*a* is disposed between the holder pin 21 and an adjustment screw 20*b* which is adjustably screwed in the housing 20 to adjust the force of the spring 20*a* against the pin 21. Any change of the force of the spring simultaneously equally changes the lateral and vertical holding force of the pin 21 against the release plate since the pin 21 simultaneously constitutes and provides the combination lateral as well as vertical safety holder force application point. A counter surface 22 is formed at the rear end 4*c* of the release plate 4, which surface cooperates with the pin 21. The counter surface 22 is concave with respect to the axis of rotation of the pivot bearing 2, and the counter surface 22 slopes downwardly toward the rear from the region of the lengthwise axis of the pin. In the laterally pivoted-out position of the release plate 4, as shown in dot-dashed lines in FIG. 2, the spring-loaded pin 21 is further pushed back and further stressed or tensioned, as indicated by the dashed end of the pin 21 in FIG. 2, due to the concave construction of the counter surface 22. The pin 21 is also pressed back and stressed or tensioned during a lifting of the release plate 4, e.g., during the vertical release. In both cases the pin 21 is biased by the single spring 20*a* so as to tend to pivot the release plate 4 back into its starting position as shown in FIG. 1 and in full line in FIG. 2. During the lateral release action, an increasing elastic range occurs until the hinge engagement element 6 departs from the guide track 7, the latter offering no lateral holding action to the hinge element 6—release plate 4 assembly. During the lateral release action of the safety ski binding, the release plate 4 pivots about the axis of the disc 2, which axis is substantially located on the extension of the axis of the skier's leg.

Instead of using the above described axially displaceable pin 21, it is also possible to employ a pivot pin which cooperates with an appropriate counter surface constructed in the form of a recess provided at the rear end of the release plate. Such a type of pivot pin is illustrated and described for instance in our Swiss Pat. No. 443,089 and U.S. Pat. No. 3,489,424 hereby incorporated by reference.

Due to the fact that the heel holder mechanisms 15–18 and 19–21 are non-moveable or not adjustable relative to the release plate 4 and to the boot heel in the lengthwise direction of the ski, whereas the toe holder mechanism 10–13 comprises longitudinally adjustable bracket means 10–13, it is possible to adjust the toe holder mechanismn to different ski boot sizes only at the toe region of the associated ski boot, without shifting or changing the position of the heel (which would otherwise affect the release action of the binding). That is the adjustment of the binding is substantially independent of and not influenced by the size of the ski boot. This is achieved by simply and exclusively accommodating the front ski boot toe binding to the size of the ski boot at the toe region.

As another inventive aspect of the invention, the different relative release moments are provided for the ski binding for the vertical release action and for the lateral release action, respectively, achieved through the co-action of the release plate 4 which is mounted at the lateral release pivot bearing 2 in conjunction with such a binding wherein a single setting lateral and vertical acting releasable holding means, e.g. 20–22, is only provided at one end of the lease plate 4, namely the rear end, and not at both ends, nor at the front which front is formed to constitute the vertical pivot fulcrum. This inherently provides the different proportional respective smaller lateral and larger vertical release lever arms. Any changing of the setting for the single spring 20*a* element safety holder pin 21 substantially equally affects the respective lateral and vertical release moments without changing their safety-proportioned actions, since the vertical release moment equals its vertical release lever arm Lv (fixed by the distance between the pivot fulcrum 5 and the force holding point 21, 22) times the effective force of the spring, and the lateral release moment equals its smaller lateral release lever arm L1 (fixed by the distance between pivot 2 and the same force holding point 21, 22) times substantially the same effective force of the spring.

Accordingly, by the present invention, a setting and adjustment of the ski binding is substantially independent of and unaffected by any size of the ski boot; and different properly proportioned release moments which are built-in with consideration of the safety of the skier, inherently occur for the vertical release action and for the lateral release action, respectively.

The heel holder mechanism is critically non-adjustable in the lengthwise direction of the ski and the toe holder mechanism comprises an adjustable, substantially U-shaped bracket mounted for pivotal movement at the front portion of the release plate about a substantially transversely extending axis. The adjustable accommodation of the toe holder mechanism can be made to different ski boot sizes at the toe region of the associated ski boot.

Since the heel holder mechanism is fixed and non-adjustable, the position of the ankle relative to the anchoring of the release plate remains practically unchanged even with different boot sizes by the present ski binding. With this ski binding, the correct adjustment of the binding itself is virtually independent of the size of the ski boot. The same binding can be used with numerous boot sizes without effectively changing the release action.

During a forward fall of the skier (FIGS. 3, 6 and 7), the release plate pivots about the hinge pin 5 (which constitutes the vertical release pivot fulcrum) at the front end of the release plate 4. The release moment effecting the vertical release action is a product of the force times the vertical release lever arm Lv about the front pivot point 5 for the release plate, which lever arm Lv is substantially the entire length of the release plate. For the lateral release (FIG. 2), the lateral release lever arm L1 is only the very short length between the force holding point 21, 22 and the pivot bearing 2. Since this lever arm L1 for the lateral release is shorter than the lever arm Lv for the vertical release, the resultant lateral moment thereby is also smaller and cannot be effectively proportionately changed by any setting of the single setting force spring 20*a*, which provides the same essential spring force change for the vertical and lateral releases (only the lateral surfaces 22 and the vertical release surfaces beneath the pin 21 are invariably formed to modify the proportions of the respective release moments to the exact best safety conditions).

Figure 4:
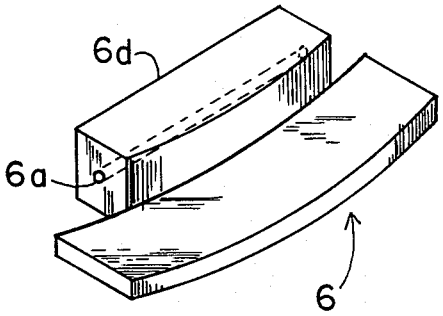
FIG. 4 is a perspective illustration of the hinge engagement member.
Figure 5:
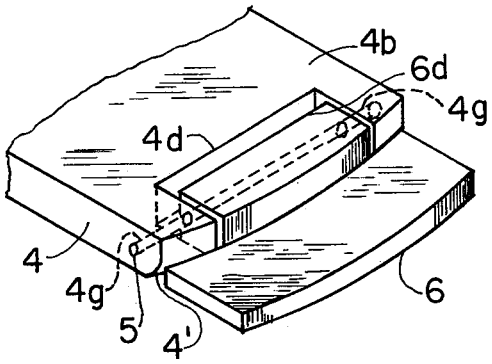
FIG. 5 is a perspective view of the front of the release plate assembled with the hinge engagement member thereon.

Referring now again to the drawings, and more particularly to FIGS. 4 and 5, a perspective view is shown of the front hinge engagement element 6 which is pivotally connected to the front end 4*b* of the release plate 4 in a central recess thereof defined by the central edge 4*d* and sides of the front of the release plate. The hinged pin 5 passes through the aligned bores 6*a* and 4*g* of the hinge 6 and the release plate 4. For the connection between the front end 4*b* of the plate 4 and the hinge 6, the front edge 4' of the release plate 4 is rounded off in order to be able to permit a pivoting of the front of the release plate 4 relative to the hinge element 6 during a forward fall.

Figure 3:
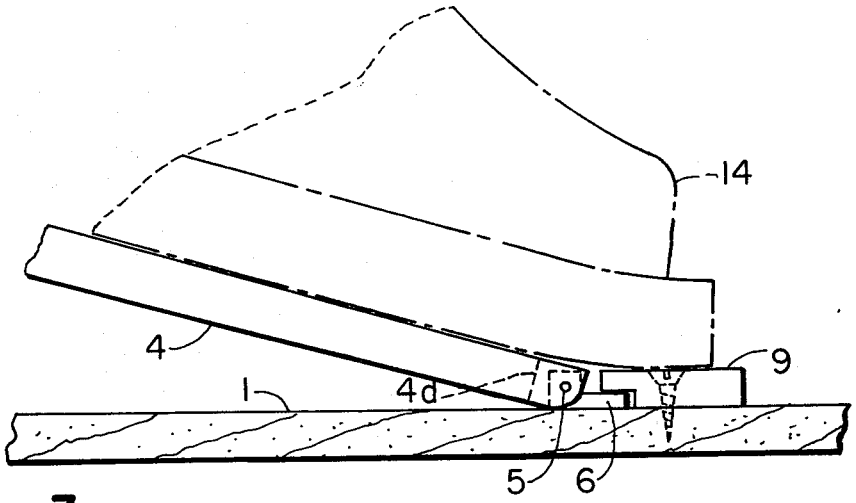
FIG. 3 is a broken away view similar to FIG. 1 showing the safety ski binding during a vertical release.
Figure 6:
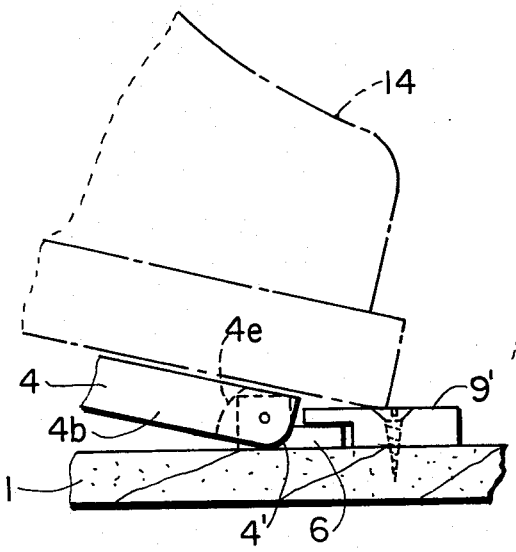
FIG. 6 is a broken away elevational view of another embodiment showing the front of the release plate during the vertical release.
Figure 7:
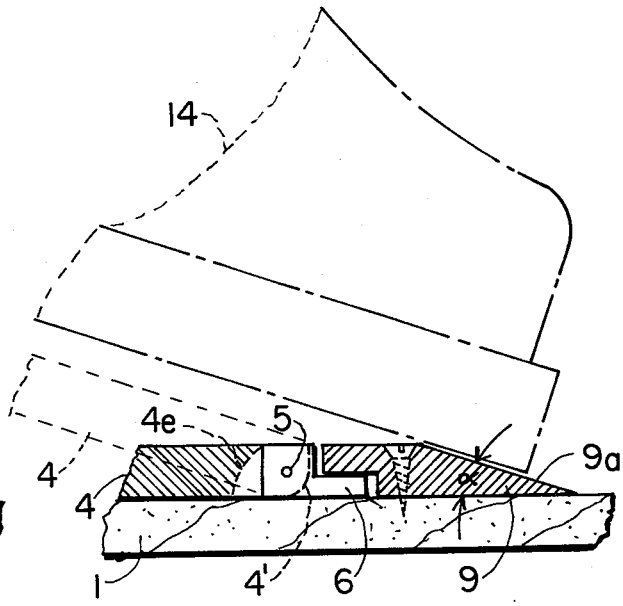
FIG. 7 is a view similar to FIG. 6 but showing still another embodiment.

Further, in order to guarantee the relative pivoting of the release plate 4 and the hinge 6, either there is provided a spacing between the central edge 4*d* of the release plate 4 and the hinge 6 (as shown in FIGS. 1, 3 and 5), or, as illustrated in FIGS. 6 and 7, the front end 4*b* of the release plate 4 in every range where it is pivoted over the rear parts of the hinge 6 must have a rearwardly running recess defined by rear extending edge 4e, which corresponds at least to the radius of the rear of the release plate 4 which pivots about the hinge pin 5.

For rigid shoe soles, the upper surface 9' of the holder plate 9 advantageously is lower than the upper surface of the release plate 4 (FIG. 6), or is formed with a forwardly inclined surface 9a (FIG. 7), the angle of inclination $\alpha$ corresponding to the required release.

While we have disclosed several embodiments of the invention, it is to be understood that these embodiments are given by example only and not in a limiting sense.

We claim:

1. A safety ski binding for a ski, comprising a release plate having a front portion and a rear portion, a rear safety release means for being operatively immovably secured to said ski for releasably holding said rear portion of said release plate on said ski, a heel holder means for being longitudinally non-adjustably connected to said rear portion of said release plate for holding a heel of a ski boot on said release plate, said heel holder means holding heels of different size ski boots, respectively, at a same position thereagainst, toe holder means operatively connected with the front portion of said release plate, said toe holder means comprising a longitudinally adjustable bracket means, said longitudinally adjustable bracket means being longitudinally adjustable for holding different size ski boots at toe regions of the ski boots, respectively, on said release plate, and said release plate being longitudinally immovably mountable on said ski relative to said rear safety means, yet releaseable relative to said immovable rear safety release means, whereby different size ski boots can be longitudinally immovably positioned on said release plate with the heels of the different size ski boots, respectively, positioned always at the same position against said heel holder means at the rear portion of said release plate and said toe holder means adjustably holding the toe regions of the ski boots, respectively, without changing the releaseable holding of said release plate, with the longitudinal immovability of said rear safety release means and non-adjustability of said heel holder means relative to said release plate, as well as the longitudinal immovability of said release plate relative to said rear safety holder means cooperating to make the releaseable holding of said release plate on said ski independent of boot sizes.

2. The ski binding as defined in claim 1, further comprising pivot bearing means disposed on a top surface of the ski for cooperating with said release plate for laterally pivotally mounting the latter, yet vertically releaseable therefrom for permitting vertical release of said release plate away from the ski, said pivot bearing means defining a lateral pivot fulcrum for said release plate substantially always aligned with the axis of the leg of a skiier wearing the different size boots, respectively, the latter held adjacent the rear portion of said release plate by said heel holder means.

3. The ski binding as defined in claim 2, wherein said release plate is formed with a recess at a point intermediate to said front portion and said rear portion, said pivot bearing means engaging in said recess.

4. The ski binding as defined in claim 3, wherein said recess has a substantially circular-shaped cross-section.

5. The safety ski boot binding as defined in claim 4, wherein said recess and said pivot bearing means are complementarily frustoconical in shape.

6. The safety ski binding as defined in claim 1, wherein said toe holder means comprises a substantially U-shaped longitudinally adjustable bracket means mounted for pivotable movement at said front portion of said release plate about a substantially transversely extending axis relative to said release plate.

7. The safety ski bearing as defined in claim 6, wherein said adjustable bracket means includes angled spindle arms with screw threaded adjustment sleeves cooperating with said release plate for the adjustment of said U-shaped bracket means in the lengthwise direction of said ski to hold the toe regions of the different size ski boots, respectively, with respect to the front portion of said release plate.

8. A safety ski binding for a ski, comprising a release plate having a front portion and an opposite rear portion, said release plate having a first pivot means intermediate said front and rear portions, second pivot means positioned on said ski cooperating with said first pivot means for mounting said release plate laterally pivotably at said pivot means on said ski for providing a pivot fulcrum for a lateral release moment of said release plate from said ski, said first and second pivot means further releasably mounting said release plate with respect to said ski for vertical release movement of said release plate away from said ski, combination lateral and vertical safety release holding means mounted on said ski only adjacent one end of said release plate for releasably holding said one end of said release plate against lateral and vertical releasing forces, respectively, and means cooperating with the other end of said release plate for forming a vertical release pivot fulcrum for said release plate at said other end, as well as for allowing said other end of said release plate to pivot freely laterally, whereby different vertical and lateral release moments exist for a vertical releasing action and a lateral releasing action, respectively, of said release plate from said safety holding means and from said ski.

9. The safety ski binding as defined in claim 8, wherein said releasable safety release holding means is mounted on said ski only adjacent said rear portion of said release plate.

10. The safety ski binding as defined in claim 8, further comprising vertical toe holder means for holding a toe portion of a ski boot against the front portion of said release plate operatively mounted on said front portion of said release plate.

11. The safety ski binding as defined in claim 8, wherein said releaseable safety release holding means is mounted on said ski only adjacent said rear portion of said release plate, a heel holder means for holding a heel of a ski boot against the rear portion of said release plate is mounted on said rear portion of the release plate, and a toe holder means for holding a toe portion of a ski boot against the front portion of said release plate is operatively mounted on said front portion of said release plate.

12. The safety ski binding as defined in claim 8, wherein said first pivot means constitutes a recess formed in a bottom of said release plate and said second pivot means is a pivot bearing mounted on the upper surface of the ski and engaging in said recess.

13. The safety ski binding as defined in claim 8, wherein said combination lateral and vertical safety release holding means constitutes a single safety release holder acting at one point on said one end of said release plate holding said one end of said release plate simultaneously against the lateral and vertical releasing forces.

14. The safety ski binding as defined in claim 8, wherein said combination lateral and vertical safety release holding means includes a single adjustable spring means for simultaneously resisting the lateral as well as vertical releasing forces on said release plate.

15. A safety ski binding for a ski, comprising a release plate having a front portion and an opposite rear portion, said release plate having a first pivot means intermediate said front and rear portions, second pivot means positioned on said ski cooperating with said first pivot means for mounting said release plate laterally pivotably at said pivot means on said ski for providing a pivot fulcrum for a lateral release moment of said release plate from said ski, said first and second pivot means further releaseably mounting said release plate with respect to said ski for vertical release movement of said release plate away from said ski, combination lateral and vertical safety release holding means mounted on said ski only adjacent one end of said release plate for releaseably holding said one end of said release plate agaiinst lateral and vertical releasing forces, respectively, and means cooperating with the other end of said release plate for forming a vertical release pivot fulcrum for said release plate at said other end, as well as for allowing said other end of said release plate to pivot freely laterally, whereby different vertical and lateral release moments exist for a vertical releasing action and a lateral releasing action, respectively, of said release plate from said safety holding means and from said ski, said means cooperating with the other end of the release plate defines a guide trackdisposed substantially concentrically with respect to said first and second pivot means.

16. The safety ski binding as defined in claim 15, further comprising a hinge engagement member pivotally connected about a transverse pivot axis with said other end of said release plate, the pivot axis defining said vertical pivot fulcrum for the vertical release, said hinge engagement member having a front end operatively complementarily disposed in said guide track.

* * * * *